US005721405A

United States Patent [19]

Hamada

[11] Patent Number: 5,721,405

[45] Date of Patent: Feb. 24, 1998

[54] TACTILE FEEDBACK MECHANISM FOR A MULTIDIRECTIONAL SWITCH

[75] Inventor: Kenichi Hamada, Komaki, Japan

[73] Assignee: Kabushiki Kaisha Tokai Rika Denki Seisakusho, Aichi, Japan

[21] Appl. No.: 802,367

[22] Filed: Feb. 19, 1997

[30] Foreign Application Priority Data

Mar. 12, 1996 [JP] Japan ..... 8-84642

[51] Int. Cl.[6] ..... H01H 9/00

[52] U.S. Cl. ..... 200/16 R; 200/18

[58] Field of Search ..... 200/4, 5 R, 5 A, 200/16 R–16 D, 517, 520, 521, 551, 547–549, 341, 345, 17 R, 18

[56] References Cited

U.S. PATENT DOCUMENTS

| | | | |
|---|---|---|---|
| 3,888,807 | 6/1975 | Lockard | 200/16 R |
| 4,429,202 | 1/1984 | Tedd et al. | 200/324 |
| 4,857,678 | 8/1989 | Lipp | 200/16 R |
| 4,871,885 | 10/1989 | Kamada | 200/5 R |
| 4,947,054 | 8/1990 | Flowers et al. | 307/125 |
| 5,120,922 | 6/1992 | Brouillette | 200/519 |

*Primary Examiner*—Michael L. Gellner
*Assistant Examiner*—Michael A. Friedhofer
*Attorney, Agent, or Firm*—Hickman Beyer & Weaver, LLP

[57] ABSTRACT

When an operating knob (12) is moved in an XA direction, an XB direction which is opposite to the XA direction, or a Y direction which is perpendicular to the XA and XB directions, coupling bars (44), (45) provided in a holder (20) which moves together with the operating knob (12) travel over slanted edges of push plates (34), (35), causing a pusher (22) to move in the Y direction. In other words, the pusher (22) moves in the same direction regardless of the moving direction of the operating knob (12). When the pusher (22) moves, a projection (33) formed at a far end of an elastic element (32) provided on the pusher (22) presses against a tactility-producing wall (40), resulting in an increase in force required for moving the operating knob (12). When the projection (33) enters an inside space of the tactility-producing wall (40), a resisting force exerted by the projection (33) disappears, resulting in a decrease in operating force, but leaving an appropriate level of tactile feedback produced when the operating knob (12) is operated. This construction eliminates the need for providing a multidirectional switch with separate mechanisms for creating tactile feedback in individual operating directions of the multidirectional switch, and thereby simplifies its construction.

6 Claims, 7 Drawing Sheets

TACTILE FEEDBACK MECHANISM FOR A MULTIDIRECTIONAL SWITCH

BACKGROUND OF THE INVENTION

1. Field of the Invention

The present invention relates generally to a tactile feedback mechanism for a multidirectional switch and, mere particularly, relates to a mechanism for enabling an operating knob of a multidirectional switch, which is operable along two intersecting axes, to produce tactile feedback, or a response with a click.

2. Description of the Related Art

Conventionally, multidirectional switches of this kind have more than one operating direction corresponding to a plurality of actions to be produced, such as opening, closing and tilt-up operations of a sunroof of a motor vehicle, for instance, in which a movable portion of the vehicle's roof is caused to open and close by sliding a single switch to the left or right, and to tilt up by pressing the same switch. An advantage of such a multidirectional switch is that excellent operability is obtainable even when an object to be controlled becomes more multi-functional, because a plurality of actions of the object can be controlled by the same switch and its movements can be matched to required actions of the object.

A common practice in the design of this type of multidirectional switch is to make it in such a way that it returns a particular tactile response to the operator's sense of touch for prohibiting accidental actuation of the multidirectional switch which may occur when the operator unintentionally touches its operating knob, for instance. This design prevents the multidirectional switch from being actuated unless at least a specific level of force is applied to the operating knob.

The conventional multidirectional switches, however, have such a problem that a mechanism for creating tactile feedback is required for each operating direction. For controlling opening, closing and tilt-up operations of a sunroof, for example, three tactile feedback mechanism are required as its operating knob is operated in three different directions. Other problem that have been pointed out in relation to the tactile feedback mechanisms of conventional design are that they increase overall physical sizes of the multidirectional switches and adjustment of tactility is required for each operating direction.

SUMMARY OF THE INVENTION

The present invention has been made to solve the aforementioned problems of the prior art. Accordingly, it is an object of the invention to provide a tactile feedback mechanism for a multidirectional switch featuring a simplified construction.

According to the invention, a tactile feedback mechanism for enabling an operating member of a multidirectional switch, which is operable along two intersecting axes, to produce tactile feedback (or click action) perceptible to an operator's sense of touch comprises a unidirectional moving member which is movable in a single predetermined direction when the operating member is operated in any of its operable directions, and a tactility-producing member for producing a tactile response in accordance with each movement of the unidirectional moving member.

In the tactile feedback mechanism of the multidirectional switch thus constructed, the unidirectional moving member converts multidirectional movements of the operating member into movements in the single predetermined direction, and the tactility-producing member can produce tactile feedback in accordance with each movement of the unidirectional moving member. A major advantage of this construction is that only one tactility-producing member is required in the multidirectional switch which has multiple moving direction of the operating member.

If the operable directions of the operating member are horizontal and vertical directions in the aforementioned tactile feedback mechanism of the multidirectional switch, it is possible to easily make a unidirectional moving member which moves exclusively in one direction when the operating member is moved in any of at least two operable directions by employing the following arrangement. Specifically, the unidirectional moving member comprises a spring element which forces the unidirectional moving member toward the operating member and an inclining element which interlocks with a coupling member provided in the operating member, whereby the inclining element causes the unidirectional moving member to move in the vertical direction in accordance with each vertical movement of the operating member and a horizontal movement of the operating member is converted into a vertical movement. In this varied construction, the unidirectional moving member moves in the vertical direction regardless of whether the operating member is moved in the horizontal or vertical direction.

The inclining element may have slanted portions symmetrically inclined in both left and right directions parallel to the horizontal axis of the operating member. In this construction, tactile feedback produced when the operating member is operated to the left side is of the same level as that produced when the operating member is operated to the right side.

In a still varied construction, the tactility-producing member comprises a u-shaped elastic element which moves in accordance with each movement of the unidirectional moving member, a projection provided at least at one end of the elastic element, and a raised portion over which the projection travels in accordance with a movement of the elastic element.

The tactility-producing member as constructed above is so simple that it makes it possible to produce compact and lightweight multidirectional switches.

DESCRIPTION OF THE PREFERRED EMBODIMENTS

The invention is now described with reference to a preferred embodiment thereof which is illustrated in the attached drawings.

Figure 8:
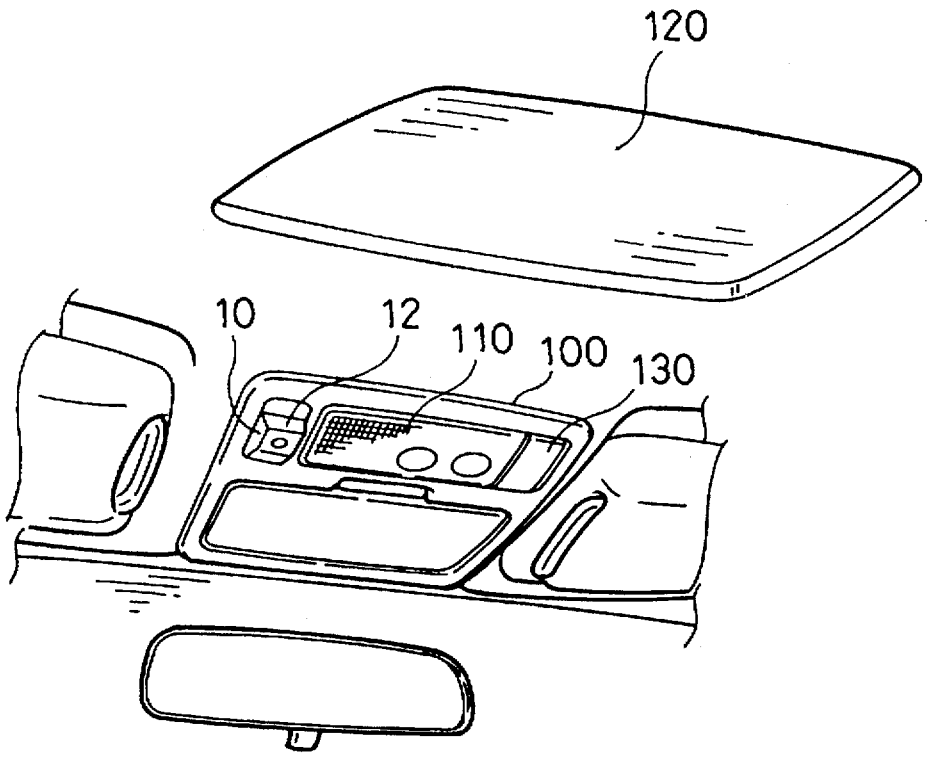
FIG. 8 is a perspective diagram illustrating the state of the multidirectional switch equipped on the motor vehicle.

As can be seen in FIG. 8, a multidirectional switch 10 of the embodiment is located in an overhead operating panel 100 which is mounted on a ceiling of a motor vehicle close to an upper edge of its windshield. The multidirectional switch 10 is used for causing a sunroof 120 provided in the vehicle's ceiling to open, close, and tilt. The overhead operating panel 100 also includes other facilities than the multidirectional switch 10, such as an on/off button 130 for a room lamp 110.

Figure 1:
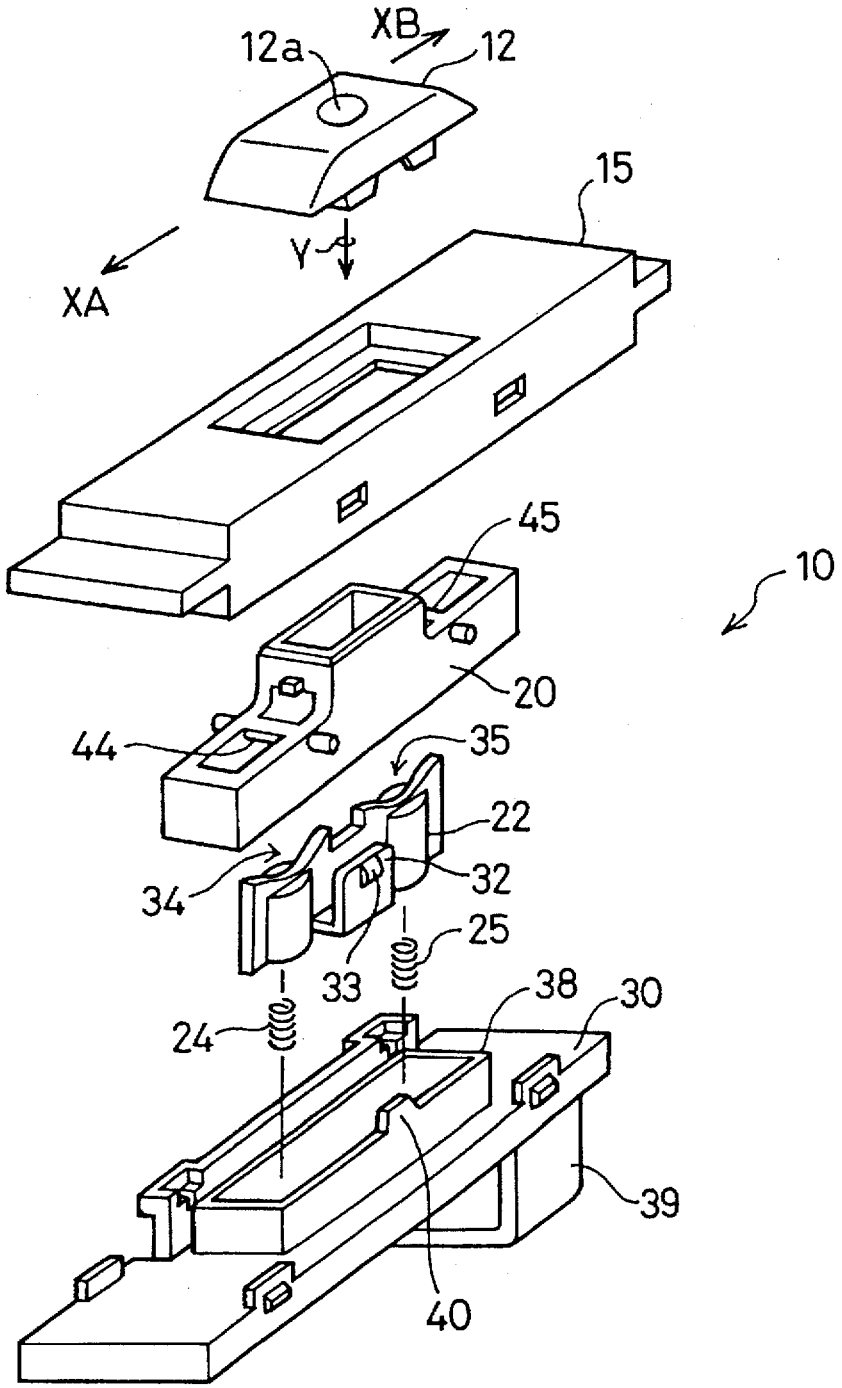
FIG. 1 is an exploded perspective diagram showing the construction of a multidirectional switch according to an embodiment of the invention.

Referring to FIG. 1, the multidirectional switch 10 generates a signal for opening the sunroof 120 when an operating knob 12 is moved in a direction shown by arrow mark XA, a signal for closing the sunroof 120 when the operating knob 12 is moved in a direction shown by arrow mark XB, and a signal for tilting up the sunroof 120 when the operating knob 12 is moved in a direction shown by arrow mark Y. The multidirectional switch 10 is installed upside down, with respect to the vertical axis shown in FIG. 1, as it is mounted on the vehicle's ceiling in actuality.

Figure 2:
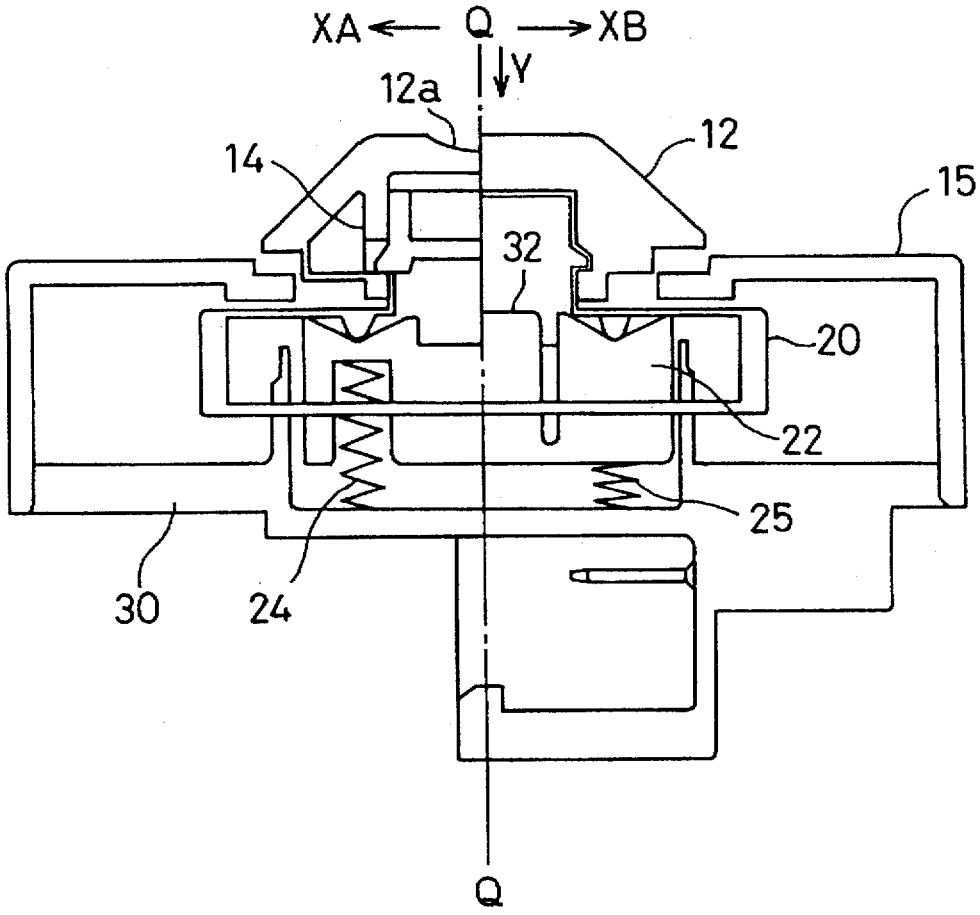
FIG. 2 is a partially sectional diagram showing the internal construction of the multidirectional switch.

As illustrated in FIGS. 1 and 2, the multidirectional switch 10 comprises a body 15 for retaining the operating knob 12, a holder 20 having a protruding portion which passes through an opening in the body 15 and fits into the operating knob 12, a pusher 22 housed in an inside space of the holder 20, and an insulator 30 which accommodates the pusher 22 while forcing it in the direction of the operating knob 12 by coil springs 24 and 25.

Figure 7:
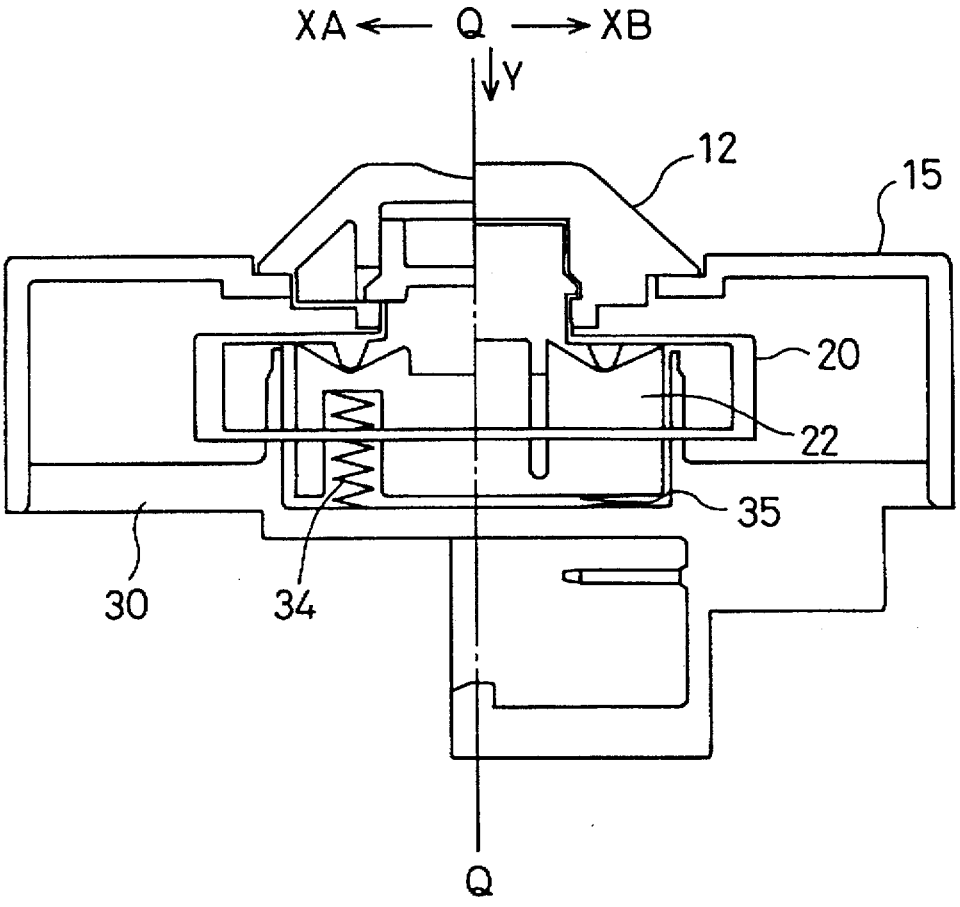
FIG. 7 is a partially sectional diagram showing how the pusher and associated components of the multidirectional switch act when its operating knob is operated in a direction shown by an arrow mark Y.

FIG. 2 is a diagram schematically illustrating how these components are assembled. The operating knob 12 is not operated at all in the status shown in FIG. 2, in which arrow marks XA, XB and Y correspond to those shown in FIG. 1. FIG. 2 shows the internal construction of the multidirectional switch 10 with the body 15 partially cut away. It is to be noted, however, that the left side of a center line Q–Q' in FIG. 2 shows cross sections of the individual components while the right side shows their outlines. This applies to FIGS. 3 and 7 as well.

A recess 12*a* is formed in an outside surface of the operating knob 12 while a connecting part 14 having a groove by which the operating knob 12 is mated to the holder 20 is formed on an inside surface of the operating knob 12. Once assembled with the holder 20, the operating knob 12 is securely mated with the holder 20 and both of these components move as a whole.

The pusher 22 is bilaterally symmetric (having mirror-image left and right halves), provided with a resin-made elastic element 32 at the middle and V-shaped push plates 34 and 35 on both sides of the elastic element 32. The far end of the elastic element 32 slightly bulges outward to form a projection 33. As will be discussed later with reference to FIG. 4, the elastic element 32 has a U-shaped structure, as seen from the direction of the arrow mark XA. The push plates 34 and 35 of the pusher 22 are located so that they fit onto coupling bars 44 and 45 provided on the left and right sides of the holder 20, respectively. Cylindrical holes are formed in the bottom of the push plates 34 and 35 to accommodate the coil springs 24 and 25, respectively. With this arrangement, the pusher 22 is forced toward the operating knob 12 by the coil springs 24 and 25 and the push plates 34 and 35 of the pusher 22 accommodated in the holder 20 are kept in contact with the coupling bars 44 and 45, respectively, when the operating knob 12 is not operated at all.

The pusher 22 is accommodated in a compartment 38 formed in the insulator 30. One side wall of the compartment 38 has a tablike projecting portion to form a wall 40. The pusher 22 is mounted so that its elastic element 32 faces the wall 40. A connector 39 for outputting switching signals to an external circuit is provided on the bottom of the insulator 30.

Figure 3:
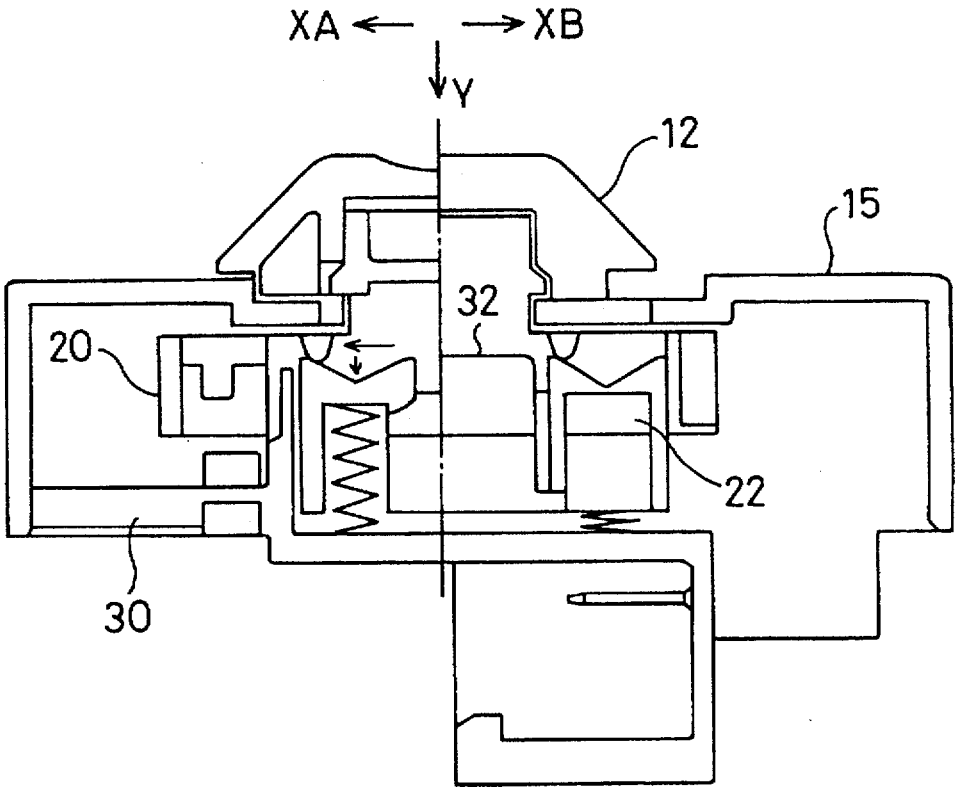
FIG. 3. is a partially sectional diagram showing how a pusher and associated components of the multidirectional switch act when its operating knob is operated in a direction shown by an arrow mark XA.
Figure 4:
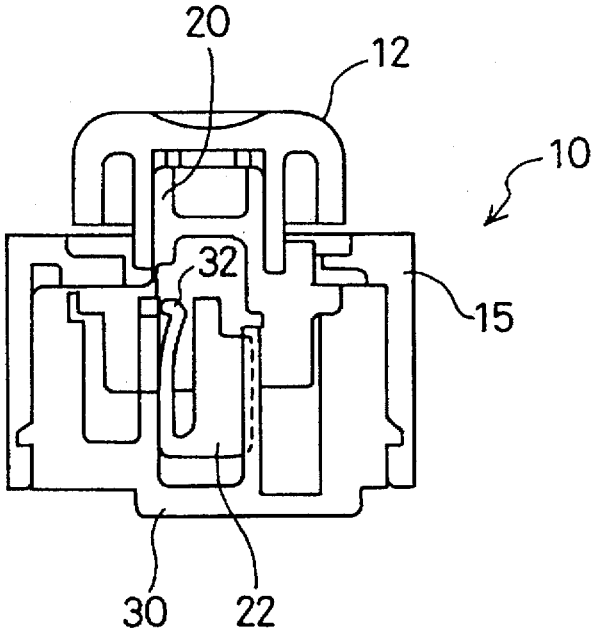
FIG. 4 is a vertical cross section of the multidirectional switch.

In the status where the operating knob 12 is not operated at all, a force exerted by the coil springs 24 and 25 causes the pusher 22 to push the holder 20 and the operating knob 12 outward via the push plates 34 and 35 and the coupling bars 44 and 45. When the operating knob 12 is forced in the horizontal direction shown by the arrow mark XA from the status shown in FIG. 2, the operating knob 12 slides in the same direction along the outside surface of the body 15. As the holder 20 is carried together with the operating knob 12, the coupling bars 44 and 45 of the holder 20 slide over the push plates 34 and 35, respectively. Since the pusher 22 is accommodated in the compartment 38 of the insulator 30 in such a way that the pusher 22 can not horizontally slide within the compartment 38, the pusher 22 is pushed in a vertical direction (Y direction) by slanted edges of the push plates 34 and 35 as illustrated in FIG. 3. FIG. 4 is a sectional diagram viewed in the direction of the arrow mark XA that is formed by cutting the multidirectional switch 10 in the status of FIG. 3 by a plane perpendicular to the arrow mark XA.

Figure 5:
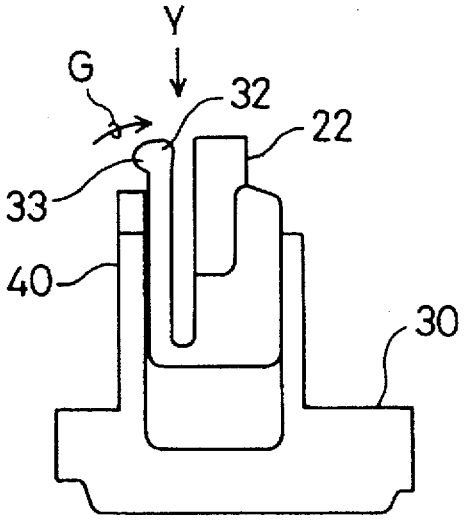
FIG. 5 is a diagram showing a mechanism for producing tactile feedback by means of an elastic element.
Figure 6:
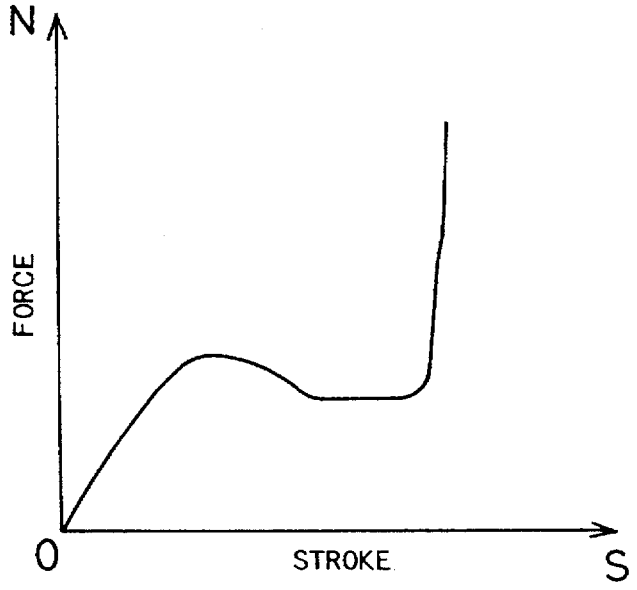
FIG. 6 is a graph showing a relationship between stroke and operating force of the operating knob.

When the pusher 22 is pushed downward, as illustrated in FIG. 5, the projection 33 provided at the far end of the elastic element 32 of the pusher 22 presses against the wall 40, resisting a downward movement of the pusher 22. As a result, the force needed for moving the operating knob 12 increases. When the pusher 22 is depressed further, causing the elastic element 32 to bend in a direction shown by an arrow mark G and the projection 33 to fit inside the wall 40, a resisting force acting against the downward movement of the pusher 22 disappears. FIG. 6 shows a relationship between resisting force N and depressed distance (or stroke S) of the operating knob 12. As the stroke S increases, the force N required for pressing the operating knob 12 also increases in the beginning and decreases after reaching a specific peak point. When such relationship exists between the stroke S and applied force N, the operating knob 12 returns an appropriate tactile response to an operator. In this case, the multidirectional switch 10 will not be actuated even when the operator accidentally touches the operating knob 12, but is actuated only when the operator intentionally manipulates the operating knob 12.

Also when the operating knob 12 is moved in the direction shown by the arrow mark XB, opposite to the direction of the arrow mark XA, the holder 20 and the pusher 22 work in almost the same way, in which the pusher 22 is depressed and the operating knob 12 returns an appropriate tactile response when operated. Furthermore, when the operating knob 12 is pushed in the direction shown by the arrow mark Y, the coupling bars 44 and 45 of the holder 20 which move in the same direction together with the operating knob 12 press against the slanted edges of the push plates 34 and 35 of the pusher 22, causing the pusher 22 to move in the Y direction. Therefore, the operating knob 12 produces an appropriate tactile response when operated in the Y direction as is the case where the operating knob 12 is operated in horizontal directions.

As seen in the foregoing discussion, the pusher 22 is moved in the Y direction regardless of whether the operating knob 12 is operated in the direction of the arrow mark XA, XB or Y in the present embodiment. This offers such advantageous effects that an appropriate tactile response is obtained due to actions of the projection 33 of the elastic element 32 and the wall 40. It would be appreciated that just a single mechanism is needed for producing tactile feedback and, therefore, the multidirectional switch 10 can be made compact and lightweight according to the invention. Furthermore, the invention provides enhanced reliability and facilitates adjustment of the intensity of tactile feedback because single tactile feedback mechanism is used. Although tactile feedback is produced by the single tactile feedback mechanism, it can be adjusted to give the same level of tactile feedback in all operating directions, or different levels of tactile feedback in the individual directions. In this embodiment, the tactile feedback produced when the operating knob 12 is operated in the XB direction is of the same level as that produced when the operating knob 12 is operated in the XA direction. This is because the left and right halves of the slanted edges of the push plates 34 and 35 have the same angle of inclination. The relationship between the stroke S and operating force N of the operating knob 12 can be varied depending on whether the operating knob 12 is operated in the XA direction or XB direction by forming the slanted edges of the push plates 34 and 35 to have different angles of the inclination at their left and right halves. The level of tactile feedback can also be varied between the XA/XB directions and the Y direction in a similar way.

while the invention has been described in combination with its specific embodiment, it is obvious that the invention is not limited thereto, but various changes and modifications can be made by those skilled in the art without departing from the spirits and scope of the invention. As an example, a multidirectional switch of the invention may be constructed in such a way that its operating knob allows not only linear movements in longitudinal, lateral and/or vertical directions but also rotary movement.

What is claimed is:

1. A tactile feedback mechanism for enabling an operating member of a multidirectional switch, which is operable along two intersecting axes, to produce tactile feedback perceptible to an operator's sense of touch, said mechanism comprising:

a unidirectional moving member which is movable in a single predetermined direction when said operating member is operated in any operable direction along the two intersecting axes; and a tactility-producing member for producing a tactile response in accordance with each movement of said unidirectional moving member.

2. A tactile feedback mechanism for a multidirectional switch as defined in claim 1, wherein the operable directions of said operating member are horizontal and vertical directions, said unidirectional moving member comprising:

a spring element which forces said operating member in the vertical direction; and an inclining element which interlocks with a coupling member provided in said operating member, whereby said inclining element causes said unidirectional moving member to move in the vertical direction in accordance with each vertical movement of said operating member and a horizontal movement of said operating member is converted into a vertical movement of the unidirectional member.

3. A tactile feedback mechanism for a multidirectional switch as defined in claim 2, wherein said inclining element has slanted portions symmetrically inclined in both left and right directions parallel to a horizontal axis of said operating member.

4. A tactile feedback mechanism for a multidirectional switch as defined in claim 3, wherein said tactility-producing member comprises a U-shaped elastic element which moves in accordance with each movement of said unidirectional moving member, a projection provided at least at one end of said elastic element, and a raised portion over which said projection travels in accordance with a movement of said elastic element.

5. A tactile feedback mechanism for a multidirectional switch as defined in claim 2, wherein said tactility-producing member comprises a U-shaped elastic element which moves in accordance with each movement of said unidirectional moving member, a projection provided at least at one end of said elastic element, and a raised portion over which said projection travels in accordance with a movement of said elastic element.

6. A tactile feedback mechanism for a multidirectional switch as defined in claim 1, wherein said tactility-producing member comprises a U-shaped elastic element which moves in accordance with each movement of said unidirectional moving member, a projection provided at least at one end of said elastic element, and a raised portion over which said projection travels in accordance with a movement of said elastic element.

* * * * *